US012604964B2

(12) United States Patent
Lee et al.

(10) Patent No.: US 12,604,964 B2
(45) Date of Patent: Apr. 21, 2026

(54) COSMETIC CONTAINER FOR A BRUSH-APPLIED COSMETIC

(71) Applicant: SAMHWA CO., LTD, Uiwang-si (KR)

(72) Inventors: Kwan Ho Lee, Suwon-si (KR); Kyung Chang Lee, Uiwang-si (KR); Ho Sang Kang, Gunpo-si (KR)

(73) Assignee: SAMHWA CO., LTD., Uiwang-si (KR)

( * ) Notice: Subject to any disclaimer, the term of this patent is extended or adjusted under 35 U.S.C. 154(b) by 755 days.

(21) Appl. No.: 17/972,555

(22) Filed: Oct. 24, 2022

(65) Prior Publication Data

US 2024/0016280 A1 Jan. 18, 2024

(30) Foreign Application Priority Data

Jul. 14, 2022 (KR) ..... 10-2022-0087140
Sep. 30, 2022 (KR) ..... 10-2022-0125235

(51) Int. Cl.
*A45D 34/04* (2006.01)
*A45D 40/24* (2006.01)
(Continued)

(52) U.S. Cl.
CPC ..... *A45D 34/046* (2013.01); *A45D 34/04* (2013.01); *A45D 40/24* (2013.01); *A45D 40/262* (2013.01);
(Continued)

(58) Field of Classification Search
CPC ..... A45D 34/046; A45D 34/04; A45D 40/24; A45D 40/262; A45D 40/267;
(Continued)

(56) References Cited

U.S. PATENT DOCUMENTS 4,525,090 A * 6/1985 Riley ..... A45D 34/045 132/320
4,929,108 A * 5/1990 Gueret ..... A45D 33/00 401/122
(Continued)

FOREIGN PATENT DOCUMENTS

FR 2753060 A1 * 3/1998 ..... A45D 40/262
KR 200375917 Y1 * 3/2005 ..... A45D 40/20
(Continued)

*Primary Examiner* — Paul R Durand
*Assistant Examiner* — Michael C Patterson
(74) *Attorney, Agent, or Firm* — Park, Kim & Suh, LLC

(57) ABSTRACT

A cosmetic container includes a first container holding a first content, an overcap in which the first container is arranged, a brush shaft including a brush shaft head and a brush shaft body, a pump module that is coupled to an opening of the first container and the brush shaft so as to dispense the first content and includes a first elastic member for elastically supporting the first container, a second container which is separably coupled to the overcap and configured to hold a second content and within which a portion of the brush shaft body may be inserted, and a container packing which is coupled to a neck part of the second container and has a lower portion in which a through-hole is formed to accommodate the brush shaft body inserted therethrough.

4 Claims, 12 Drawing Sheets

(51) Int. Cl.
*A45D 40/26* (2006.01)
*A46B 9/02* (2006.01)
*A46B 11/00* (2006.01)
*A46B 15/00* (2006.01)

(52) U.S. Cl.
CPC ..... *A45D 40/267* (2013.01); *A46B 9/021* (2013.01); *A46B 11/002* (2013.01); *A46B 15/0051* (2013.01); *A45D 2200/051* (2013.01); *A45D 2200/056* (2013.01); *A45D 2200/058* (2013.01); *A46B 2200/1053* (2013.01)

(58) Field of Classification Search
CPC ..... A45D 2200/051; A45D 2200/056; A45D 2200/058; A46B 9/021; A46B 11/002; A46B 15/0051; A46B 2200/1053
USPC ..... 401/16, 17, 47, 188 R, 122, 128–130
See application file for complete search history.

(56) References Cited

U.S. PATENT DOCUMENTS 4,961,664 A * 10/1990 Simper ..... A45D 40/265 401/127
5,096,319 A * 3/1992 Gueret ..... A45D 40/265 401/129
5,096,320 A * 3/1992 Norman ..... A45D 34/045 401/129
5,116,154 A * 5/1992 Fulkerson ..... A45D 34/045 401/129
5,284,239 A * 2/1994 Kiricoples ..... A45D 34/046 132/73
6,164,857 A * 12/2000 Wolfarth-Brooks ..... A45D 34/045 401/126
6,609,848 B1 * 8/2003 Rosenberg ..... A46B 15/0071 401/148
6,789,970 B1 * 9/2004 Shearon ..... A46B 7/023 401/127
6,872,020 B2 * 3/2005 Epli ..... B65D 51/32 401/129
7,467,906 B2 * 12/2008 Gueret ..... A45D 34/042 401/129
8,783,988 B2 * 7/2014 Sanchez ..... A45D 34/04 401/109
8,926,206 B2 * 1/2015 Suzuki ..... A45D 40/267 401/121
2007/0177927 A1 * 8/2007 Kurihara ..... A45D 40/267 401/122
2011/0030718 A1 * 2/2011 Gueret ..... A45D 40/262 401/122
2011/0311295 A1 * 12/2011 McBratney ..... A46B 9/021 401/129
2012/0012131 A1 * 1/2012 Go ..... A45D 40/265 132/218
2019/0082810 A1 * 3/2019 Roh ..... A45D 34/045
2021/0106116 A1 * 4/2021 Gim ..... A45D 40/24

FOREIGN PATENT DOCUMENTS

KR 10-1478974 B1 1/2015
KR 200481972 Y1 * 12/2016 ..... A45D 34/00
WO WO-2020096090 A1 * 5/2020 ..... A45D 40/267

* cited by examiner

COSMETIC CONTAINER FOR A BRUSH-APPLIED COSMETIC

CROSS-REFERENCE TO RELATED APPLICATIONS

This application claims the benefit of Korean Patent Application No. 10-2022-0087140, filed with the Korean Intellectual Property Office on Jul. 14, 2022, and Korean Patent Application No. 10-2022-0125235, filed with the Korean Intellectual Property Office on Sep. 30, 2022, the disclosures of which are incorporated herein by reference in their entirety.

BACKGROUND

Technical Field

The present invention relates to a cosmetic container, more particularly to a cosmetic container for a brush-applied cosmetic.

Description of the Related Art

Mascara is a cosmetic for lengthening and thickening the eyelashes to provide a more clearly defined impression and is applied on the eyelashes by way of a brush dabbed in a cosmetic liquid. Since a mascara liquid is applied near the user's eyes, the mascara liquid is made to vaporize and dry quickly, so as to prevent the liquid from touching the eyes. As such, the mascara liquid held within a container undergoes quick drying and hardening, making it difficult to use the mascara product.

To resolve this problem, a mascara container has been developed that can prevent the mascara liquid from contacting air and allow a dispensing of the mascara liquid only when the cosmetic is used. When using this conventional mascara container, a user may rotate a portion of the mascara container, upon which the cosmetic liquid within the container may be dispensed to the brush portion. However, this conventional type of mascara container requires a complicated structure and still entails the problem of inconvenient use, as the cosmetic liquid applied on the brush portion undergoes drying and hardening.

SUMMARY OF THE INVENTION

An aspect of the present invention, which was conceived to resolve the problem described above, is to provide a cosmetic container that can mitigate the drying and hardening of the cosmetic liquid and keep the pressure within the container at a suitable level.

Other objectives of the present invention will be more clearly understood from the embodiments set forth below.

One aspect of the invention provides a cosmetic container that includes: a first container configured to hold a first content; an overcap, in an upper portion of which an open region is formed to expose a portion of the first container, and within which the first container is arranged; a brush shaft comprising a brush shaft head and a brush shaft body, with the brush shaft head arranged within the overcap and the brush shaft body having a discharge channel formed to allow a passage of the first content and a discharge hole formed to connect the discharge channel with the exterior; a pump module, which is disposed within the overcap, is coupled to an opening of the first container and the brush shaft so as to dispense the first content from the first container to the discharge channel, and includes a first elastic member for elastically supporting the first container such that the first container is movable relative to the brush shaft; a second container, which is separably coupled to the overcap and configured to hold a second content, and within which a portion of the brush shaft body may be inserted; and a container packing, which is coupled to a neck part of the second container and made from a flexible material, and in a lower portion of which a through-hole is formed to accommodate a portion of the brush shaft body inserted therethrough.

A cosmetic container according to an embodiment of the present invention can include one or more of the following features. For example, the container packing can include: a packing body that has a cylindrical shape and has an outer diameter corresponding to an inner diameter of the neck part of the second container; and a wiper which is located below the packing body and in which the through-hole is formed.

The cosmetic container can further include a second elastic member for elastically supporting the brush shaft such that the brush shaft is movable relative to the overcap between a first position and a second position, where the degree of elastic deformation of the second elastic member at the second position can be greater than the degree of elastic deformation of the second elastic member at the first position.

The brush shaft body can have a venting indentation, which can be positioned at the through-hole and can allow a flow of air through the through-hole when the brush shaft is moved to the second position.

The container packing can include: a packing body having a cylindrical shape and having an outer diameter corresponding to the inner diameter of the neck part of the second container; and a wiper which is located below the packing body and in which the through-hole is formed, while the brush shaft body can include: a broad portion having an outer diameter corresponding to the inner diameter of the packing body; and a narrow portion having an outer diameter corresponding to the inner diameter of the through-hole. In this case, a sealing protrusion configured to contact the outer perimeter of the broad portion can be formed on the inner perimeter of the packing body, and a venting indentation can be formed in the broad portion to be positioned at the sealing protrusion such that at least a portion of the sealing protrusion does not contact the broad portion when the brush shaft is moved to the second position.

A support protrusion can be formed on the inner perimeter of the overcap, an outwardly protruding flange can be formed on an upper portion of the packing body, and the flange can be pressed between the support protrusion of the overcap and the neck part of the second container when the overcap is coupled to the second container. In this case, the second elastic member can be disposed between the support protrusion and the brush shaft head. A sealing protrusion can be formed on an upper surface of the flange.

An embodiment of the present invention having the features above can provide various advantageous effects including the following. However, an embodiment of the present invention may not necessarily exhibit all of the effects below.

An embodiment of the invention can allow the user to dilute the second content with the first content, so that the user may conveniently use the second content even when it has become hardened or concentrated due to drying.

An embodiment of the invention can tightly seal the first container, which holds the first content, and the second container, which holds the second content, to prevent the contents from leaking, while at the same time keeping the pressure within the second container at a suitable level.

DETAILED DESCRIPTION OF THE INVENTION

Figure 1:
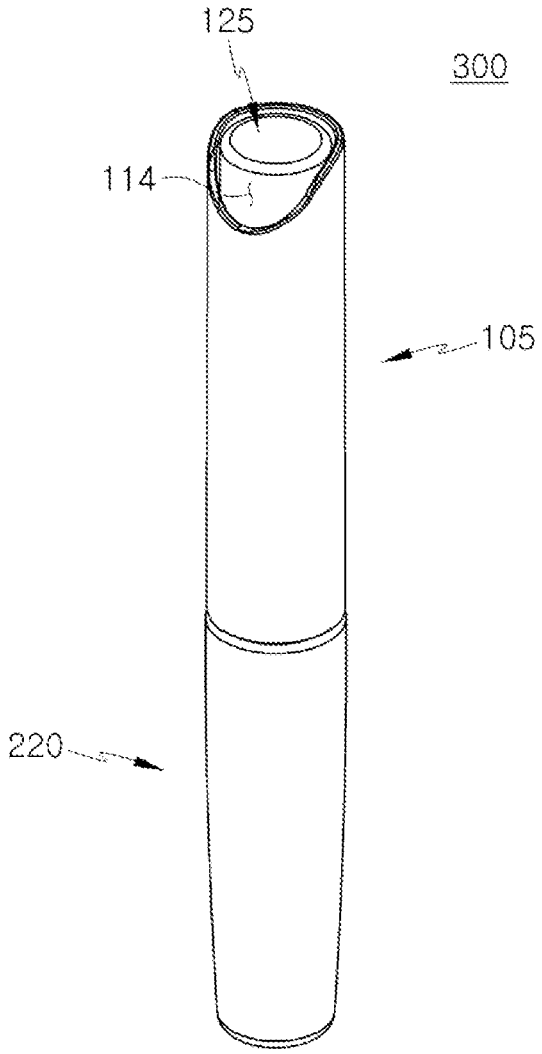
FIG. 1 is a perspective view illustrating a cosmetic container according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

Figure 2:
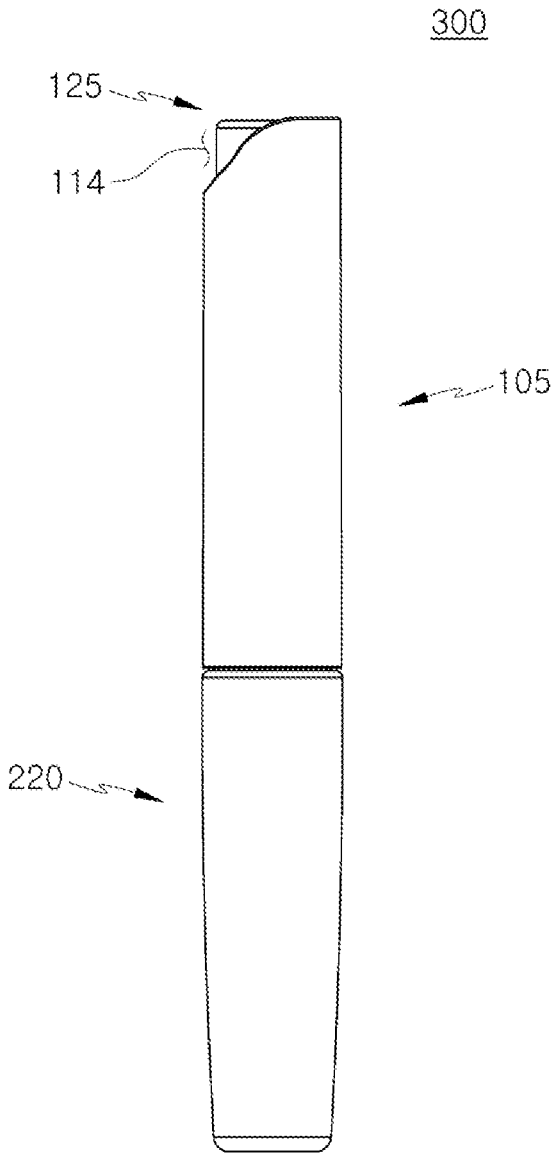
FIG. 2 is a front elevational view of the cosmetic container illustrated in FIG. 1.
Figure 3:
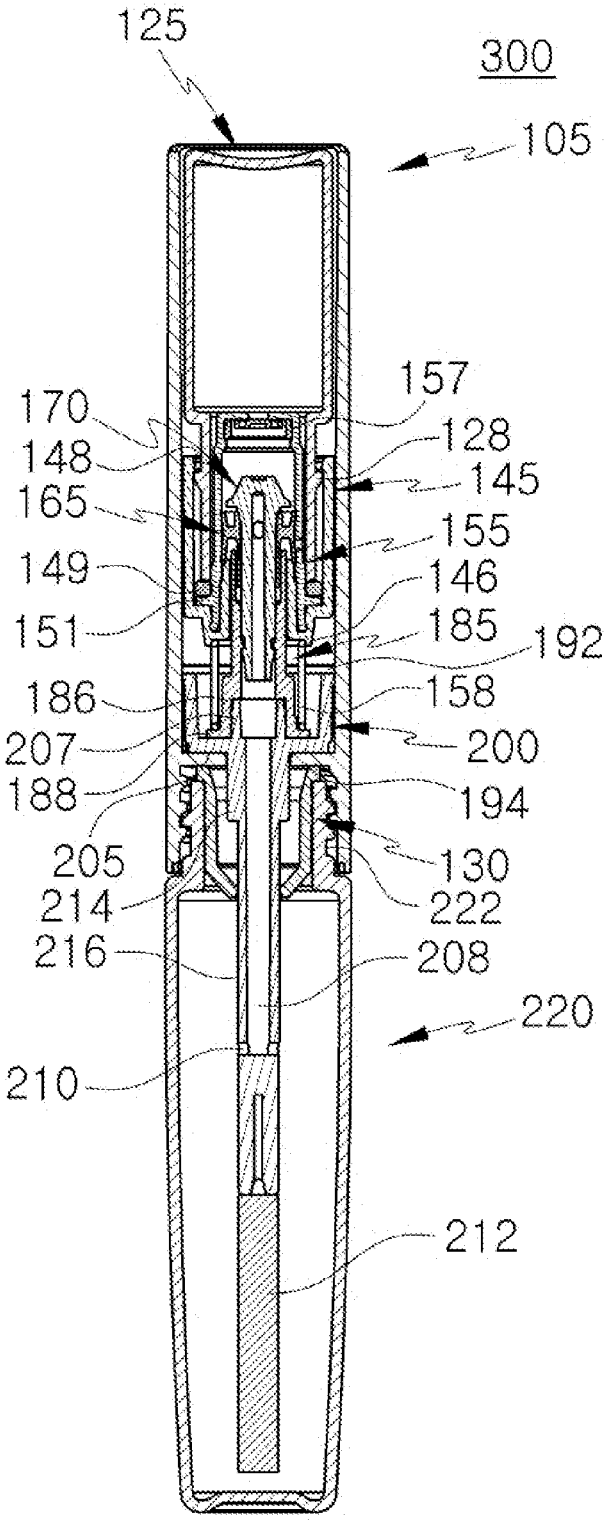
FIG. 3 is a cross-sectional view of the cosmetic container illustrated in FIG. 1.
Figure 4:
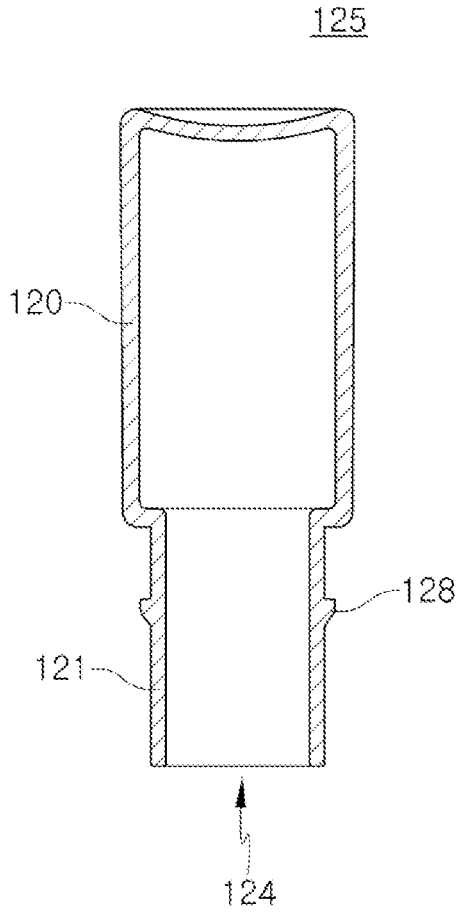
FIG. 4 is a cross-sectional view of the first container in the cosmetic container illustrated in FIG. 1.
Figure 5:
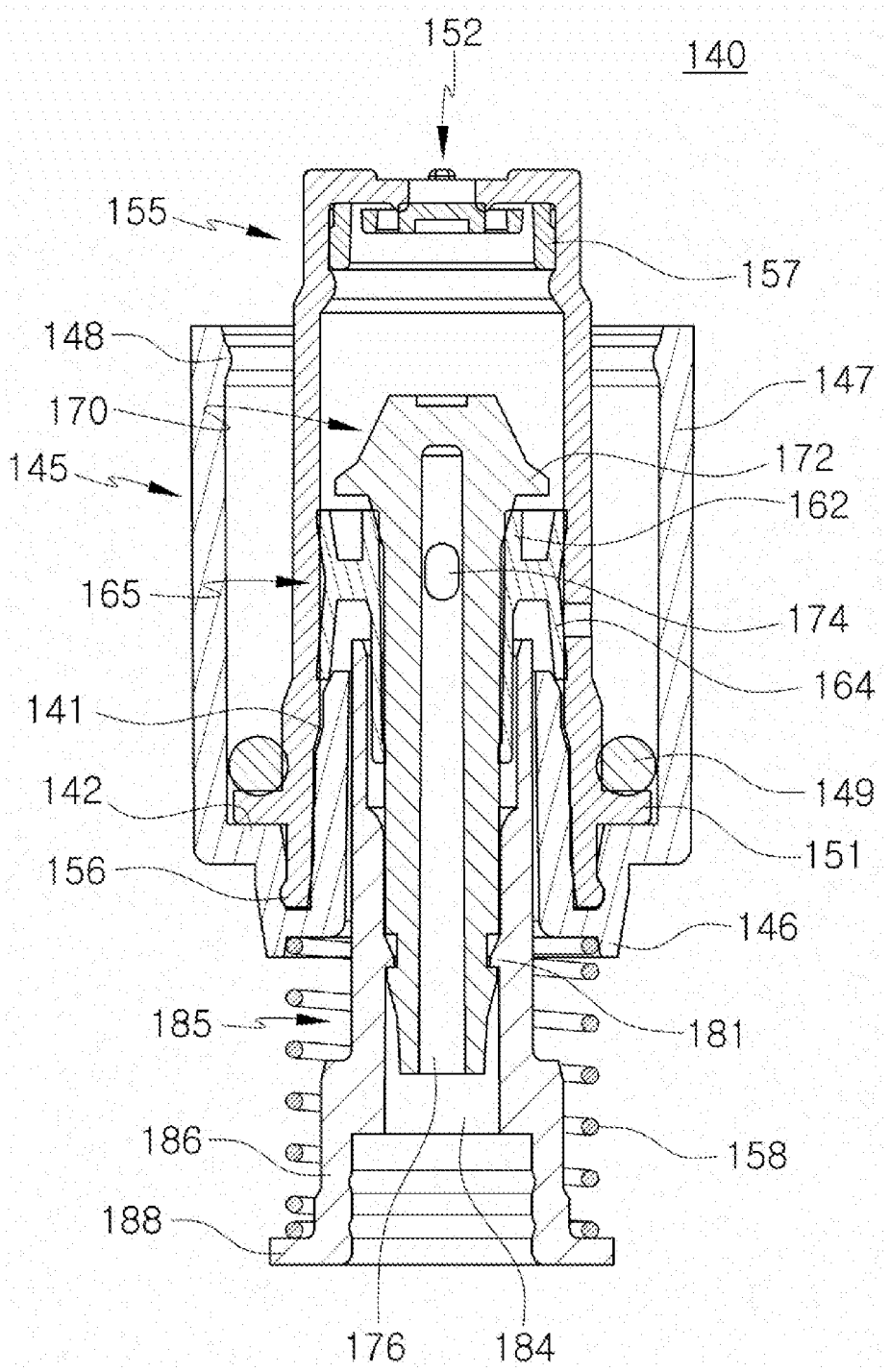
FIG. 5 is a cross-sectional view of the pump module in the cosmetic container illustrated in FIG. 1.

FIG. 1 is a perspective view illustrating a cosmetic container 300 according to a first disclosed embodiment of the invention, and FIG. 2 and FIG. 3 are a front elevational view and a cross-sectional view of the cosmetic container illustrated in FIG. 1, respectively. FIG. 4 and FIG. 5 are cross-sectional views of the first container 125 and the pump module 140 in the cosmetic container 300 illustrated in FIG. 1.

Referring to FIGS. 1 to 5, a cosmetic container 300 according to this embodiment may be operated by a downward pressure applied on the first container 125 at the top. When the downward pressure is applied, the pump module 140 can inject a first content (not shown) within the first container 125 into the inside of the second container 220 through the brush shaft 200. The inside of the second container 220 may be filled with a second content, where the second content can be mixed with and diluted by the injected first content for use.

In cases where a cosmetic container 300 according to this embodiment is a mascara container, the second content can be a mascara liquid, and the first content can correspond to a saline solution, etc. Thus, the user can use a saline solution to dilute the mascara liquid or dissolve a piece of hardened mascara to use the mascara liquid in a convenient manner. Of course, a cosmetic container 300 based on this embodiment does not necessarily have to be a mascara container, and there are no limits as to the types, properties, and usages of the first and second contents.

Referring to FIGS. 1 to 5, a cosmetic container 300 according to this embodiment may include an overcap 105, a first container 125, a container packing 130, a pump module 140, a brush shaft 200, and a second container 220. Although there are slight differences between the first disclosed embodiment and second disclosed embodiment of the invention set forth in the present specification, if there are corresponding elements in both embodiments, reference numerals used in describing the second disclosed embodiment can be used in the descriptions of the first disclosed embodiment, and vice versa.

The overcap 105 can have a wall 116 forming the shape of a hollow cylinder, so that a housing space 115 (see FIG. 7) may be formed on the inside, and can house the first container 125, the pump module 140, and a portion of the brush shaft 200 within the housing space 115. A support protrusion 194 for supporting the brush shaft head 202 (see FIG. 8) of the brush shaft 200 can be formed on the inside of the overcap 105, and a through-hole 193 through which the brush shaft body 218 (see FIG. 8) of the brush shaft 200 may pass can be formed on the inside of the support protrusion 194.

An open region 114 can be formed in an upper portion of overcap 105, where the open region 114 can be formed across the upper surface and perimeter surface of the overcap 105 as illustrated in the drawings. More specifically, the open region 114 can be formed over the entire upper surface and a part of the perimeter surface of the overcap 105, and a portion of the first container 125 can be exposed through the open region 114. The open region 114 may expose a portion of the perimeter surface and upper surface of the first container 125, which has been inserted into the overcap 105, to the outside, thereby allowing the user to press down on the first container 125 as well as to perceive the amount of content remaining in the first container 125. As the top of the overcap 105 has a height corresponding to the top of the first container 125, the possibility of the first container 125 being pressed unintentionally can be reduced, compared to a structure in which the top of the first container 125 protrudes beyond the top of the overcap 105.

In cases where the open region 114 is formed over the entire upper surface of the overcap 105 as illustrated in the drawings, the brush shaft 200, pump module 140, and first container 125 can be readily mounted within the housing space 115 in said order. After the first container 125, pump module 140, and brush shaft 200 are assembled within the housing space 115, these can be firmly secured to one another so as not to become separated through the open region 114 in the top of the overcap 105. For example, an inwardly protruding detent protrusion 192 can be provided on the inner perimeter of the overcap 105. The detent protrusion 192 can be formed in a position corresponding to the top of the brush shaft head 202, and the brush shaft head 202 can be secured in its proper position as the brush shaft 200 is inserted between the detent protrusion 192 and the support protrusion 194.

When assembling a cosmetic container 300 according to this embodiment, the manufacturer can insert the brush shaft 200 through the open region 114 of the overcap 105, first inserting the brush shaft body 218 through the through-hole 193, and then applying pressure such that the brush shaft head 202 passes over the detent protrusion 192. When the brush shaft head 202 passes over the detent protrusion 192, the brush shaft head 202 can be secured between the detent protrusion 192 and the support protrusion 194, and the manufacturer can subsequently insert and assemble a connector member 185, an elastic member 158, a housing cover 145, a piston 165, a guide 170, and a housing 155 in said order.

The overcap 105 can be separably coupled to the second container 220, for which a coupling means such as a female thread 196, etc., can be formed in the inner perimeter of a lower part of the overcap 105. Since the brush shaft body 218 of the brush shaft 200 protrudes below the overcap 105 through the through-hole 193, the brush shaft body 218 can be inserted into the second container 220 when the overcap 105 is coupled to the second container 220.

As described above, the first container 125 can hold a first content therein, and when the user presses down on the first container 125, the first content can be injected through the discharge channel 208 of the brush shaft 200 and into the inside of the second container 220 by the pump module 140. The first container 125 can be fabricated with a transparent material, so that the user may readily perceive the amount of first content remaining in the first container 125 through the open region 114.

Referring to FIG. 4 and FIG. 5, the first container 125 can include a holding part 120, which may be filled with the first content (not shown), and a neck part 121, which may correspond to the entrance portion. An opening 124 can be formed in a lower portion of the neck part 121, and the inside of the holding part 120 can be open towards the outside through the opening 124. The neck part 121 can have a smaller outer diameter compared to that of the holding part 120 for easy coupling with the pump module 140. As the neck part 121 has a reduced diameter, the portion of the first container 125 other than the neck part 121 can have a similar outer diameter as that of the housing cover 145.

When the first container 125 is coupled to the pump module 140, the housing 155 of the pump module 140 can be inserted through the opening 124 and into the neck part 121 of the first container 125, and the neck part 121 can be inserted between the housing cover 145 and housing 155 of the pump module 140. For a more secure coupling between the first container 125 and the pump module 140, an outwardly protruding detent protrusion 128 can be formed on the outer perimeter of the neck part 121 of the first container 125. The detent protrusion 128 can engage the detent protrusion 148 of the housing cover 145 to secure the first container 125 onto the pump module 140.

Referring again to FIGS. 1 to 3, the container packing 130 can be coupled to the neck part 222 of the second container 220 to provide a sealing function. The container packing 130 can have a packing body 134, of which both the top and bottom may be open, where a flange 132 and a wiper 136 can be formed on the upper end and lower end of the packing body 134 (see FIG. 9). The outer perimeter of the packing body 134 can be coupled to tightly contact the inner perimeter of the neck part 222 of the second container 220. The container packing 130 can be fabricated from a more flexible material (such as PE, for example) compared to other parts of the cosmetic container 300, so as to undergo a slight elastic deformation when pressed and thereby provide a strong sealing function.

The flange 132 formed on the upper end of the packing body 134 can have an outwardly protruding structure and can be formed along the entire perimeter to have an annular shape. The flange 132 can be caught on the top of the neck part 222 of the second container 220. When the overcap 105 is coupled to the second container 220, the flange 132 can be pressed between the support protrusion 194 of the overcap 105 and the neck part 222 of the second container 220 to tightly seal the second container 220.

The wiper 136 can be provided at a lower end of the container packing 130. The wiper 136 can, for example, be formed with an inward inclination and can be placed in tight contact with the narrow portion 216 of the brush shaft body 218, as illustrated in FIG. 3. Thus, when the brush shaft 200 is separated from the second container 220, any residue of second content remaining on the narrow portion 216 can be wiped off and removed by the wiper 136. A through-hole 138 (see FIG. 9) can be formed in the center of the wiper 136. The narrow portion 216 of the brush shaft body 208 can pass through the through-hole 138.

The pump module 140 can be coupled to the neck part 121 of the first container 125 and can serve to move the first content held in the first container 125 to the discharge channel 208 of the brush shaft 200. The pump module 140 can include a housing cover 145, a housing 155, an elastic member 158, a piston 165, a guide 170, and a connector member 185.

The housing cover 145 can house certain components of the pump module 140 and at the same time can aid the coupling of the pump module 140 onto the neck part 121 of the first container 125. The housing cover 145 can be structured such that both its top and bottom are open and can have a cover ledge 142 and an inner protrusion 141 formed on the inside.

The housing cover 145 can be divided by the cover ledge 142 into two portions having different diameters. On the outer side of the cover ledge 142, a perimeter element 147 can extend upward with a larger diameter. The perimeter element 147 can extend to a length corresponding to the length of the guide 170, and the detent protrusion 148 of the housing cover 145 can be formed on the inner perimeter at the upper end of the elongated perimeter element 147. While the detent protrusion 128 of the first container 125 is in engagement with the detent protrusion 148 of the housing cover 145, the container rim 124 of the first container 125 may be supported by the cover ledge 142. Here, a length corresponding to the length of the guide 170 can be the length of the entire guide 170, the length below the guide flange 172, or another length value close to these length values. Such structure of the housing cover 145 can prevent the outer perimeter of the first container 125 from touching the inner perimeter of the overcap 105 by more firmly securing the first container 125 in its designated position within the limits of an already required volume, i.e., without increasing the volume beyond what is necessary, and can therefore prevent the occurrence of dents in the surface of the first container 125 made from a transparent material.

While the detent protrusion 128 of the first container 125 is in engagement with the detent protrusion 148 of the housing cover 145, the lower end of the first container 125 can be supported by the cover ledge 142. As illustrated in the drawings, a pressing protrusion 151 of the housing 155 can be arranged between the lower end of the first container 125 and the cover ledge 142, and a sealing member 149 can further be provided between the lower end of the first container 125 and the pressing protrusion 151.

The inner protrusion 141 may be structured as a hollow cylinder formed in the center at a lower end of the housing cover 145, with both its top and bottom open. The inner piston 162 of the piston 165 can be inserted at the top of the inner protrusion 141, and the connector member 185 can be inserted at the bottom of the inner protrusion 141. More specifically, the inner protrusion 141 can extend upward from a downwardly extended portion of the cover ledge 142 to thereby form a gap between the inner protrusion 141 and the cover ledge 142, and the lower end of the housing 155 can be inserted into the gap between the inner protrusion 141 and the cover ledge 142. It is possible also to form a detent protrusion 156 on the lower end of the housing 155.

The sealing member 149 can be formed from a flexible material such as silicone, etc., and can be formed in an annular shape in the manner of an 0 ring. The sealing member 149 can provide a sealing function from its position between the lower end of the first container 125 and the cover ledge 142 of the housing cover 145 and, at the same time, can provide a more secure coupling by pushing the detent protrusion 128 of the first container 125 against the detent protrusion 148 of the housing cover 145.

The housing 155 may be the part that is inserted to the inside of the first container 125 and can be structured to be open at both its upper end and lower end. The lower end of the housing 155 can be inserted into the inside of the housing cover 145. The elastic member 158, guide 170, and piston 165 can be arranged within the housing 155.

A housing inlet hole 152 may be formed in the upper end of the housing 155. A disk valve 157 can be mounted at the housing inlet hole 152, and when the disk valve 157 is opened, the first content within the first container 125 can flow through the housing inlet hole 152 and into the interior of the housing 155.

The housing 155 can have an elongated outer perimeter that may be placed in tight contact with the inner perimeter of the neck part 121 of the first container 125. The lower end of the housing 155 can extend below the pressing protrusion 151 and can be inserted and secured between the cover ledge 142 and inner protrusion 141 of the housing cover 145. The inner protrusion 141 of the housing cover 145 can extend upward while maintaining tight contact with the inner perimeter of the housing 155, extending to a position higher than the pressing protrusion 151. An upper portion of the connector member 185 can be inserted through the inside of the inner protrusion 141, where the upper portion of the connector member 185 can extend to a position higher than the inner protrusion 141 of the housing cover 145 even when the first container 125 is not pressed down.

The outer perimeter of the housing 155 and the inner perimeter of the neck part 121 may be placed in tight contact over a greater length, the outer perimeter of the inner protrusion 141 of the housing cover 145 and the inner perimeter of the housing 155 may also be placed in tight contact over a greater length, and a sealing member 149 may be provided at the point of contact where the first container 125, housing cover 145, and housing 155 meet. It is also possible to have the outer perimeter of the neck part 121 and the inner perimeter of the perimeter element 147 of the housing cover 145 contact each other more tightly. For two members that contact each other, tight contact over a greater length provides watertightness over an increased area of surface contact, which can be advantageously used to prevent the first content from leaking out of the first container 125 and the pump module 140. Even when there is no downward pressure on the first container 125, the connector member 185 can support the entire inner protrusion 141 of the housing cover 145 from the inside, thereby further reducing the possibility of gaps occurring between the above members.

Also, with the detent protrusion 128 of the first container 125 engaging the detent protrusion 148 of the housing cover 145 and the sealing member 149 arranged under the lower end of the first container 125, the sealing member 149 made from a slightly elastic material can enable the detent protrusions 128, 148 to push against each other more strongly, and conversely the engagement between the detent protrusions 128, 148 can push the sealing member 149 into tighter contact with its surroundings. In this way, the structure described above can further increase the sealing function of the corresponding part.

A disk valve 157 can be provided at the housing inlet hole 152 in the upper end of the housing 155. The disk valve 157 can open or close the housing inlet hole 152 depending on the pressure within the housing 155. For example, when the first container 125 is pressed down so that the pressure within the housing 155 increases, the disk valve 157 can ascend and close the housing inlet hole 152. When the external force applied on the first container 125 is removed so that the pressure within the housing 155 decreases, the disk valve 157 may descend, and the housing inlet hole 152 may be opened, thus allowing the first content to flow through the housing inlet hole 152 to the inside of the housing 155.

The elastic member 158 can elastically support the first container 125 such that the first container 125 is movable relative to the brush shaft 200. In the embodiment illustrated in FIGS. 1 to 5, the elastic member 158 is arranged between a lower portion of the housing cover 145 and a flange 188 of the connector member 185. Since the brush shaft head 202 of the brush shaft 200 is secured to the connector member 185 and the first container 125 is secured to the housing cover 145, the elastic member 158 can enable the assembly of the first container 125, housing cover 145, and housing 155 to move in relation to the assembly of the guide 170, connector member 185, and brush shaft 200.

Referring to FIG. 5, a securing protrusion 146 may be formed in an annular shape on a lower surface of the housing cover 145, and a flange 188 may be formed on the connector member 185 at the lower end of the coupler part 186. The elastic member 158 can be mounted around the outer perimeter of the connector member 185 to be arranged between a lower surface of the housing cover 145 and the flange 188, where the upper end of the elastic member 158 can be secured on the inner side of the securing protrusion 146, and the lower end of the elastic member 158 can be supported on the flange 188. The elastic member 158 can correspond to a coil spring, but the invention is not to be limited by the shape or material of the elastic member.

With the elastic member 158 positioned in this manner, the elastic member 158 need not contact the first content. In cases where the elastic member 158 is made of a material such as metal, etc., as in the case of a coil spring, contact between the elastic member 158 and the first content can create a risk of the content being contaminated or spoiled by the elastic member 158 and can also create a risk of the elastic member 158 being corroded by the liquid content. However, by positioning the elastic member 158 on the outside of the pump module 140 as in the present embodiment, it is possible to increase the lifespan of the elastic member 158 while preventing any spoiling of the first content and second content. In the present specification, the elastic member 158 used for operating the pump module 140 may also be referred to as a first elastic member 158, to distinguish it from another elastic member 258 (see FIGS. 10 to 12) described later on.

The piston 165 can be positioned around the guide 170 and can serve to open or close the guide inlet holes 174 formed in the perimeter of the guide 170. The piston 165 can be provided with an inner piston 162 and an outer piston 164, which may have different diameters and may be arranged in a concentric shape.

The inner piston 162 can be located on the inside of the outer piston 164 and can be positioned to tightly contact the outer perimeter of the guide 170. The inner piston 162 can move up or down in conjunction with the upward or downward movement of the housing 155, as a result of which the guide inlet holes 174 can be opened or closed.

The outer piston 164 can be located on the outside of the inner piston 162 and can be positioned to tightly contact the inner perimeter of the housing 155. Because of such tight contact of the outer piston 164, the piston 165 can be move downward as well when the housing 155 is moved downward.

The guide 170 can have a flow channel 176 formed therein, thus providing a channel through which the first content that has entered the inside of the housing 155 can move to the brush shaft 200. The guide 170 can be coupled by the connector member 185 to an upper portion of the brush shaft 200, and the inner piston 162 of the piston 165 can be positioned around the guide 170. A guide flange 172 can be formed on an upper portion of the guide 170, where the guide flange 172 can limit the extent to which the piston 165 may move upward.

The pump module 140 and the first container 125 coupled thereto may be coupled in a movable manner in relation to the guide 170 and the connector member 185, whereas the piston 165 may be caught on the guide flange 172 and may thus be limited from moving upward beyond the designed range. As a result, not only the connector member 185 but all of the first container 125, pump module 140, guide 170, and connector member 185 may be prevented from moving up beyond the designed range. This may eliminate the need for the overcap 105 to support the first container 125 at the top as described above and therefore makes it possible to form the open region 114 of the overcap 105 over the entire upper surface of the overcap 105.

Guide inlet holes 174 can be formed in the perimeter of the guide 170. The guide inlet holes 174 can connect with the flow channel 176 inside the guide 170. The flow channel 176 can be formed along the lengthwise direction of the guide 170 and can connect with the guide inlet holes 174 at the top and with the flow channel 184 of the connector member 185 at the bottom. The first content that has entered the interior of the housing 155 can move through the guide inlet holes 174, pass through the flow channel 176 of the guide 170 and the flow channel 184 of the connector member 185, and move to the discharge channel 208 of the brush shaft 200. The guide inlet holes 174 can be opened or closed by the inner piston 162.

The connector member 185 can serve to connect the pump module 140 with the brush shaft 200 and can have the flow channel 184 formed therein. At the upper part of the connector member 185, the guide 170 can be inserted into the connector member 185, while at the lower part of the connector member 185, the flow channel 184 of the connector member 185 can be connected with a coupling hole 206 of the brush shaft head 202. The flow channel 184 can be formed through the entire length of the connector member 185, and the first content that has entered the inside of the guide 170 can pass through the connector member 185 and enter the discharge channel 208 of the brush shaft 200.

In the embodiment illustrated in FIGS. 1 to 5, a portion of the brush shaft head 202 is inserted into the flow channel 184 of the connector member 185. More specifically, a boss 207 can be formed on the brush shaft head 202 around the coupling hole 206. The boss 207 can extend upward from the brush shaft head 202 and can have a channel formed within that connects to the coupling hole 206. The lower portion of the connector member 185 can be provided with a coupler part 186 that has an increased diameter and a shape corresponding to that of the boss 207.

A male thread can be formed on the outer perimeter of the boss 207, a corresponding female thread can be formed in the inner perimeter of the coupler part 186, and the connector member 185 can be coupled to the brush shaft head 202 by way of a screw joint between the coupler part 186 and the boss 207. As the connector member 185 is coupled to the brush shaft head 202, the flow channel 184 of the connector member 185 may naturally connect with the coupling hole 206 of the brush shaft head 202. When the connector member 185 is thus coupled to the brush shaft head 202 by a screw joint, the connector member 185 may not easily be detached, even when an upward pulling force is applied.

As described above, a flange 188 can be provided at a lower portion of the connector member 185. The flange 188 can serve to provide a stable support for the connector member 185 on the flat element 205 of the brush shaft head 202 as well as to secure and support the lower end of the elastic member 158.

The brush shaft 200 can correspond to an applicator provided with a brush 212 for applying the second content and can provide a channel through which the first content may move to the inside of the second container 220. The brush shaft 200 can mainly include a brush shaft head 202 and a brush shaft body 208, where the brush shaft body 218 can include a broad portion 214, which may be configured not to pass through the through-hole 138 of the container packing 130, and a narrow portion 216, which may be configured to pass through the through-hole 138. A discharge channel 208 can be formed within the brush shaft 200 to allow a flow of the first content, where the discharge channel 208 can continue from the coupling hole 206 at the upper part of the brush shaft 200 and continue to the discharge holes 210 at the lower part.

The brush shaft head 202 can be positioned above the support protrusion 194 on the inside of the overcap 105. The brush shaft head 202 can include a cylindrically shaped perimeter element 204 and a flatly shaped flat element 205 at a lower portion of the perimeter element 204 so as to be shaped as a cylinder having an open top. The brush shaft head 202 can be configured to have the connector member 185 coupled to its center. For this, a boss 207 can be formed around the coupling hole 206 on the flat element 205 of the brush shaft head 202, as described above, and a male thread can be formed on the outer perimeter of the boss 207 that mates with the female thread formed in the inner perimeter of the coupler part 186 of the connector member 185. The perimeter element 204 of the brush shaft head 202 may contact the inner perimeter of the overcap 105, whereby the brush shaft 200 can be positioned in a stable manner without shaking within the housing space 115 of the overcap 105.

The brush shaft body 218 can protrude down from the center of a lower portion of the brush shaft head 202 and can correspond to the part that is inserted into the second container 220. Within the brush shaft body 218, a discharge channel 208 can be formed through which the first content may move, where the discharge channel 208 can connect with the discharge holes 210. The discharge holes 210 can be positioned inside the second container 220 and allow a spraying of the first content to the inside of the second container 220.

The brush shaft body 218 can include a broad portion 214 and a narrow portion 216. The narrow portion 216 can have an outer diameter corresponding to the inner diameter of the through-hole 138 of the container packing 130, while the broad portion 214 can have an outer diameter that is larger than that of the narrow portion 216. The outer diameter of the broad portion 214 can be smaller than the outer perimeter of the brush shaft head 202 and can correspond to the inner diameter of the through-hole 193 of the overcap 105.

Figure 8:
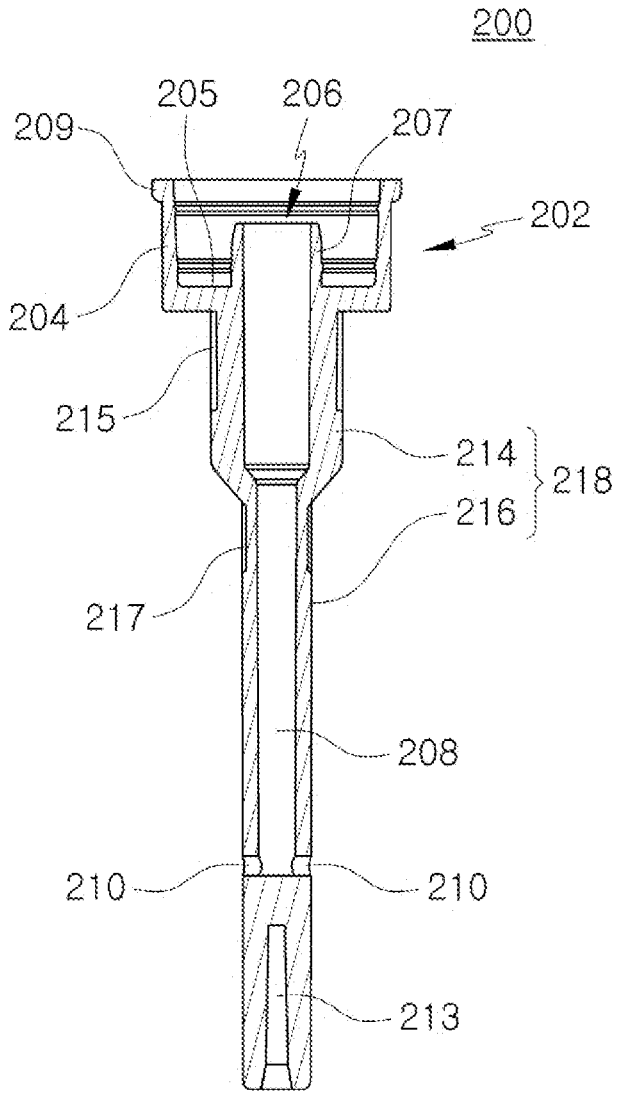
FIG. 8 is a cross-sectional view of the brush shaft in the cosmetic container illustrated in FIG. 6.

A coupler recess 213 can be provided at the lower end of the narrow portion 216 of the brush shaft body 218, and the brush 212 can be coupled to the narrow portion 216 as a portion of the brush 212 is inserted into the coupler recess 213 (see FIG. 8).

The discharge holes 210 can be positioned above the brush 212, so that the first content discharged through the discharge holes 210 may not be discharged onto the brush 212 directly but rather may be discharged into the inside of the second container 220. This can enable the user to readily dilute any hardened second content by using the sprayed first content.

The second container 220 may be a container holding the second content (not shown) and can have a neck part 222 formed at its upper portion. The second container 220 can be shaped as a hollow cylinder having a closed bottom and an open top and can include a neck part 222 where the diameter is reduced to form a ledge (no numeral assigned). A male thread 224 can be formed on the outer perimeter of the neck part 222, where the male thread 224 can form a screw joint with the female thread 196 formed in a lower portion of the overcap 105.

If the second content filled in the second container 220 has hardened, or if the user wishes to use the second content in a diluted form, the user may simply press down on the first container 125. When the user applies a downward force on the portion of the first container 125 that is exposed through the open region 114 of the overcap 105, the elastic member 158 can be deformed, allowing the housing cover 145 and the housing 155, together with the first container 125, to move downward. The piston 165 can also move downward together with the housing 155, so that the guide inlet holes 174 formed in the guide 170 can be opened. As this creates an increase in pressure within the housing 155, the disk valve 157 can maintain a closed state.

The first content that was filled in the housing 155 can flow through the opened guide inlet holes 174 into the flow channel 176 of the guide 170, to subsequently move through the flow channel 184 of the connector member 185 and the discharge channel 208 of the brush shaft body 218 and be discharged to the inside of the second container 220. Since the first content is discharged through the discharge holes 210 formed in the brush shaft body 218 above the brush 212 into the second container 220 rather than onto the brush 212 directly, the first content can be used to readily dilute the second content.

When the external force applied on the first container 125 is removed, the first container 125, the housing cover 145, and the housing 155 can be moved back upward by the restoring force of the elastic member 158. The piston 165 can also move up together with the housing 155, thereby closing the guide inlet holes 174 formed in the guide 170. At this juncture, the first content that was inside the housing 155 has been expended, and the volume inside the housing 155 is increased due to the upward movement of the housing 155, so that the pressure inside the housing 155 is low. As a result, the disk valve 157 can be opened, and the first content held within the first container 125 can again move into the interior of the housing 155.

When the user wishes to use the second content, the user can grip and rotate the overcap 105 to separate the overcap 105 from the second container 220. When the overcap 105 is separated from the second container 220, the brush shaft 200 may also be separated from the second container 220, and the user can apply the second content (which may have been diluted with the first content) carried on the brush 212 of the brush shaft 200.

According to the first disclosed embodiment of the invention described above, the user can use hardened or concentrated second content by employing a simple pressing action to dilute the second content with the first content. When the user wishes to use the brush 212 and separates the overcap 105, the narrow portion 216 of the brush shaft 200 may pass through the through-hole 138 of the container packing 130, in the process of which the wiper 136 can wipe the second content off the outer perimeter of the narrow portion 216, thereby decreasing the likelihood of surrounding objects being contaminated by the second content as a result of carelessness by the user.

The cosmetic container 300 according to the first disclosed embodiment of the invention can tightly seal the first container 125 and the second container 220 without any unnecessary increases in volume and can thus decrease the likelihood of the first and/or second content leaking out and contaminating surrounding objects.

Figure 6:
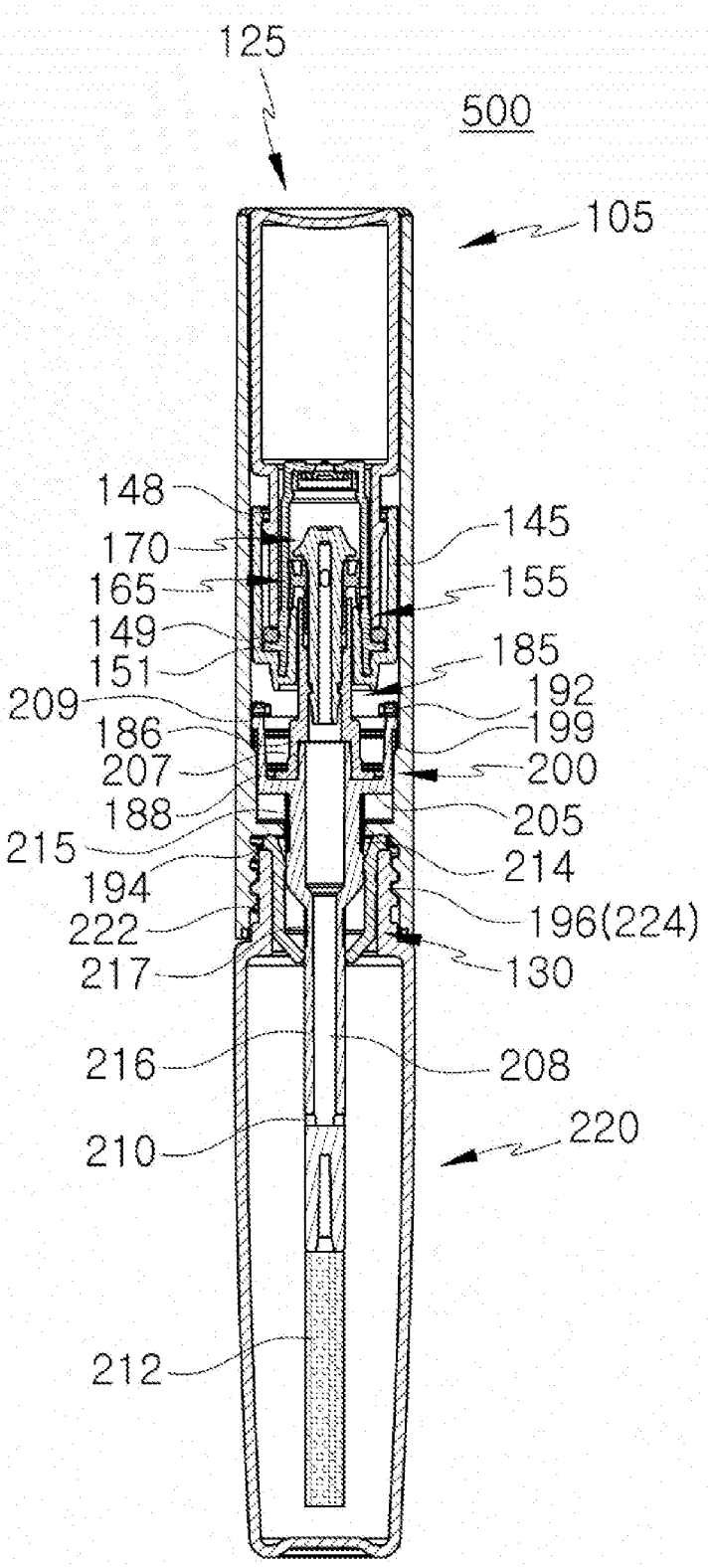
FIG. 6 is a cross-sectional view illustrating a cosmetic container according to a second disclosed embodiment of the invention.
Figure 7:
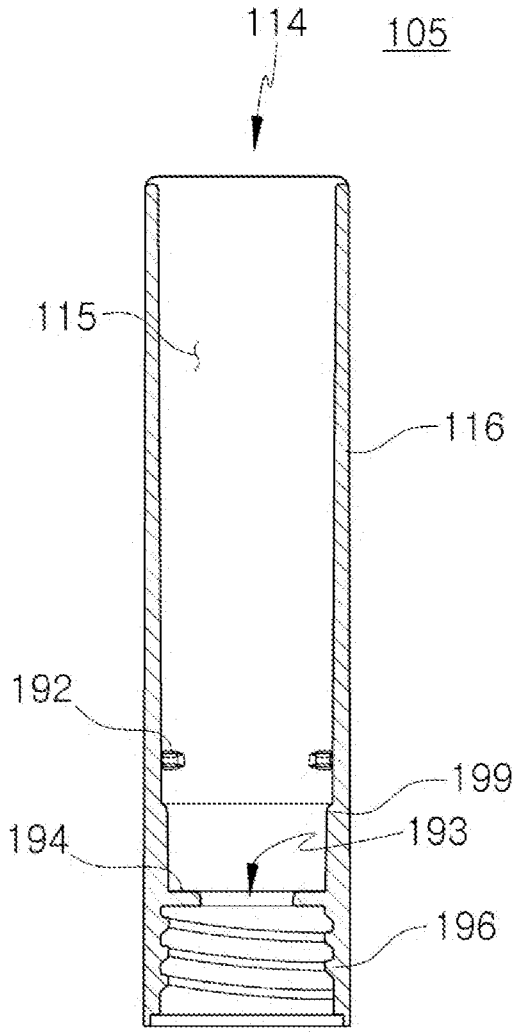
FIG. 7 is a cross-sectional view of the overcap in the cosmetic container illustrated in FIG. 6.
Figure 9:
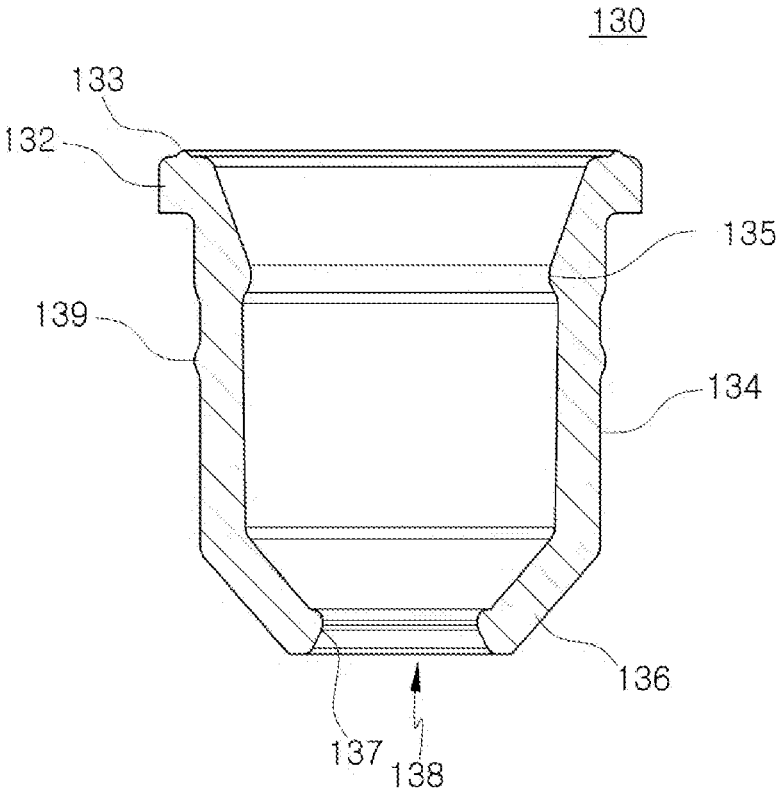
FIG. 9 is a cross-sectional view of the container packing in the cosmetic container illustrated in FIG. 6.

FIG. 6 is a cross-sectional view illustrating a cosmetic container 500 according to a second disclosed embodiment of the invention. FIGS. 7, 8, and 9 are cross-sectional views of the overcap 105, brush shaft 200, and container packing 130 in the cosmetic container 500 illustrated in FIG. 6. A cosmetic container 500 according to the second disclosed embodiment of the invention has many features in common with a cosmetic container 300 according to the first disclosed embodiment described above, and the following descriptions will focus more on the differences of the cosmetic container 500 according to the second disclosed embodiment. Features described with respect to the first disclosed embodiment can be applied to the second disclosed embodiment, and likewise, features described with respect to the second disclosed embodiment can be applied to the first disclosed embodiment. Certain reference numerals mentioned in the description of the second disclosed embodiment are intended to refer to corresponding components of the components designated by the reference numerals in the first disclosed embodiment.

Similarly to a cosmetic container 300 based on the first disclosed embodiment described above, in a cosmetic container 500 according to this embodiment also, pressing down on the first container 125 at the top may cause the first content (not shown) filled in the first container 125 to be injected by the pump module 140 through the brush shaft 200 and into the second container 220. The interior of the second container 220 may be filled with a second content, and the second content can be mixed with and diluted by the injected first content.

However, if the user dispenses the first content from the first container 125 into the second container 220 while the second container 220 is in a tightly sealed state, the pressure within the second container 220 may be increased correspondingly. This can cause the second content within the second container 220 to spurt out to the exterior when the user pulls out the brush shaft 200 to use the second content or at other inopportune times. The cosmetic container 500 according to the second disclosed embodiment of the invention is designed to have a structure that can prevent such an occurrence.

A cosmetic container 500 according to the second disclosed embodiment of the invention can include an overcap 105, a first container 125, a container packing 130, a pump module 140, a first elastic member 158, a brush shaft 200, a second container 220, and a second elastic member 258. One difference from the cosmetic container 300 of the first disclosed embodiment is that the cosmetic container 500 according to the second disclosed embodiment can include a second elastic member 258 that supports the brush shaft 200 such that the brush shaft 200 is movable relative to the overcap 105, in addition to the first elastic member 158 for operating the pump module 140.

Due to the elastic support by the second elastic member 258, the brush shaft 200 can be configured to be movable between a first position and a second position in relation to the overcap 105. The first position can, for example, be a position corresponding to the second elastic member 258 being in a less deformed or undeformed state, whereas the second position can, for example, be a position corresponding to the second elastic member 258 being in a more deformed state. That is, the degree of elastic deformation of the second elastic member 258 at the second position can be greater than the degree of elastic deformation of the second elastic member 258 at the first position.

Referring to FIG. 7, in a cosmetic container 500 according to the second disclosed embodiment of the invention, the overcap 105 can further include a detent curb 199 in addition to the components described above. The detent curb 199 can be a part where the inner diameter of the overcap 105 is increased on the inner side of the wall 116, such that the inner diameter is smaller below the detent curb 199 than above the detent curb 199.

The detent curb 199 can be formed in a position between the detent protrusions 192 and the support protrusion 194 and can be formed in a position corresponding to the lower surface of the flange 209 formed on the brush shaft head 202 (see FIG. 8) when the brush shaft 200 is in the second position. In this embodiment, the brush shaft 200 may be coupled such as to be movable relative to the overcap 105, where the detent protrusions 192 can limit the flange 209 of the brush shaft head 202 from above when the brush shaft 200 is in the first position, and the detent curb 199 can limit the flange 209 of the brush shaft head 202 from below when the brush shaft 200 is in the second position.

While FIG. 3 illustrates an example in which the detent protrusion 192 of the overcap 105 is formed in a band-like shape traversing the entire inner perimeter of the overcap 105, the detent protrusion 192 can be formed in certain other embodiments as intermittent protrusions, as in the example illustrated in FIG. 7. In cases where the flange 209 of the brush shaft head 202 is formed as a continuous band as in the illustrated drawings, forming the detent protrusions 192 as intermittent protrusions can allow an easier coupling of the brush shaft 200. Of course, in certain embodiments, the detent protrusion 192 can be implemented in a continuous form, and the flange 209 of the brush shaft head 202 can be implemented in the form of intermittent protrusions.

In a cosmetic container 500 based on this embodiment, the support protrusion 194 of the overcap 105 can be formed to tightly contact the broad portion 214 of the brush shaft body 218. That is, the through-hole 193 on the inner side of the support protrusion 194 can be formed with an inner diameter corresponding to the outer diameter of the broad portion 214 of the brush shaft body 218, and in portions other than the through-hole 193, the support protrusion 194 can be configured to completely block any flow of gas and liquid.

Referring to FIG. 8, in a cosmetic container 500 according to the second disclosed embodiment of the invention, the brush shaft 200 can be composed of a brush shaft head 202 and a brush shaft body 218, in a manner similar to the brush shaft 200 of the first disclosed embodiment.

The brush shaft head 202 can include a perimeter element 204 and a flat element 205 to form the shape of a hollow cylinder having an open top, where a flange 209 can be formed on the outer side of the perimeter element. As already described above, the brush shaft 200 can be moved between the first position and the second position due to the second elastic member 258, and the flange 209 can move correspondingly between the detent protrusion 192 and the detent curb 199.

The brush shaft body 218 can include a broad portion 214 and a narrow portion 216. In this embodiment, the broad portion 214 can be configured to have an outer diameter that corresponds to the inner diameter of the through-hole 193 of the overcap 105 and at the same time corresponds to the inner diameter of the packing body 134 (see FIG. 9) of the container packing 130. Also, the narrow portion 216 of the brush shaft body 218 can have an outer diameter that corresponds to the inner diameter of the through-hole 138 of the container packing 130, as in the first disclosed embodiment described above. When the brush shaft 200 is in the first position, i.e., when there is no external force applied on the first container 125, the broad portion 214 of the brush shaft body 218 can tightly contact the through-hole 193 of the overcap 105 and the inner perimeter of the container packing 130, and the narrow portion 216 can tightly contact the through-hole 138 of the container packing 130, so that the watertightness of the second container 220 may be further increased.

Venting indentations 215 can be formed in an upper part of the broad portion 214. A venting indentation 215 can be an indentation formed in the outer perimeter of the broad portion 214 and can extend a particular distance along the lengthwise direction of the broad portion 214. The venting indentations 215 can be formed in positions corresponding to the through-hole 193 of the overcap 105 when the brush shaft 200 is in the second position after having moved relative to the overcap 105. Thus, when the brush shaft 200 is moved to the second position, the venting indentations 215 can move to the positions corresponding to the through-hole 193, and the broad portion 214 of the brush shaft body 218 may no longer seal the through-hole 193. In this state, air from the second container 220 can be exhausted through the venting indentations 215 and through-hole 193 to the housing space 115.

Similarly, venting indentations 217 can also be formed in an upper part of the narrow portion 216. A venting indentation 217 can be an indentation formed in the outer perimeter of the narrow portion 216 and can extend a particular distance along the lengthwise direction of the narrow portion 216. The venting indentations 217 can be formed in positions corresponding to the through-hole 138 of the container packing 130 when the brush shaft 200 is in the second position after having moved relative to the overcap 105. Thus, when the brush shaft 200 is moved to the second position, the venting indentations 217 can move to the positions corresponding to the through-hole 138, and the narrow portion 216 of the brush shaft body 218 may no longer seal the through-hole 138. In this state, air from the second container 220 can be exhausted through the venting indentations 217 and through-hole 138 to the interior of the container packing 130.

Referring to FIG. 9, the container packing 130 of a cosmetic container 500 according to the second disclosed embodiment of the invention can include a flange 132, a packing body 134, and a wiper 136, and these can be similar to the components of the container packing 130 described in relation to the first disclosed embodiment of the invention. The container packing 130 can be fabricated from a material (such as PE, for example) that is more flexible than other parts of the cosmetic container 500 and can undergo a slight elastic deformation when pressed to thereby provide a strong sealing function.

A sealing protrusion 133 can be formed on the flange 132 of the container packing 130. The sealing protrusion 133 can protrude upward from an upper surface of the flange 132 and can be formed continuously along the flange 132 so as to have an annular shape. When the overcap 105 is coupled to the neck part 222 of the second container 220, the support protrusion 194 and the upper end of the second container 220 can press against the flange 132, which may be positioned in-between. At this juncture, the sealing protrusion 133 can be more easily deformed due to its small size and can provide a gapless seal between the overcap 105 and the container packing 130.

A sealing protrusion 135 can also be formed on the packing body 134 of the container packing 130. The sealing protrusion 135 can be formed continuously along the inner perimeter of the packing body 134 so as to have an annular shape. The broad portion 214 of the brush shaft 200 can have an outer diameter corresponding to the inner diameter of the packing body 134, and the sealing protrusion 135 can protrude further towards the inside of the packing body 134. The sealing protrusion 135 can be more easily deformed due to its small size and can provide a gapless seal between the packing body 134 and the broad portion 214 when the brush shaft 200 is in the first position, within the limits of not inhibiting the movement of the brush shaft 200.

A sealing protrusion 137 can also be formed on the wiper 136 of the container packing 130. The sealing protrusion 137 can be formed continuously along the inner perimeter of the through-hole 138 at the lower end of the wiper 136 so as to have an annular shape. The narrow portion 216 of the brush shaft 200 can have an outer diameter corresponding to the inner diameter of the through-hole 138, and the sealing protrusion 137 can protrude further towards the inside of the through-hole 138. The sealing protrusion 137 can be more easily deformed due to its small size and can provide a gapless seal between the wiper 136 and the narrow portion 216 when the brush shaft 200 is in the first position, within the limits of not inhibiting the movement of the brush shaft 200.

A sealing protrusion 139 can also be formed on another part of the packing body 134 of the container packing 130. The sealing protrusion 139 can be formed continuously along the outer perimeter of the packing body 134 so as to have an annular shape. The packing body 134 of the container packing 130 can have an outer diameter corresponding to the inner diameter of the neck part 222 of the second container 220, and the sealing protrusion 139 can protrude further towards the outside of the packing body 134. The sealing protrusion 139 can be more easily deformed due to its small size and can provide a gapless seal between the packing body 134 and the neck part 222.

The sealing protrusions 133, 135, 137, 139 formed on the container packing 130 can provide sealing between the container packing 130 and other members contacting the container packing 130. The sealing protrusions 133, 135, 137, 139 can enhance the function of the container packing 130 in preventing any unintended leakage of the second content from the second container 220 to the exterior.

As described above, in a cosmetic container 500 according to the second disclosed embodiment of the invention, the brush shaft 200 can be configured to be movable between a first position and a second position within the housing space 115 of the overcap 105, and a second elastic member 258 can be provided for this purpose.

The second elastic member 258 can, for example, be arranged between a lower surface of the brush shaft head 202 and the support protrusion 194. In this case, a coil spring having a frustoconical shape can be used for the second elastic member 258, in consideration of the narrow space. Of course, the shape and position of the second elastic member 258 can be selected from a variety of options.

When there is no external force applied on the first container 125, the second elastic member 258 can be in an undeformed or a less deformed state, and the brush shaft 200 can be placed in the first position by the second elastic member 258. When an external force is applied on the first container 125 such that the second elastic member 258 is deformed, the brush shaft 200 can move downward to be arranged at the second position, as the second elastic member 258 is compressed.

Figure 10:
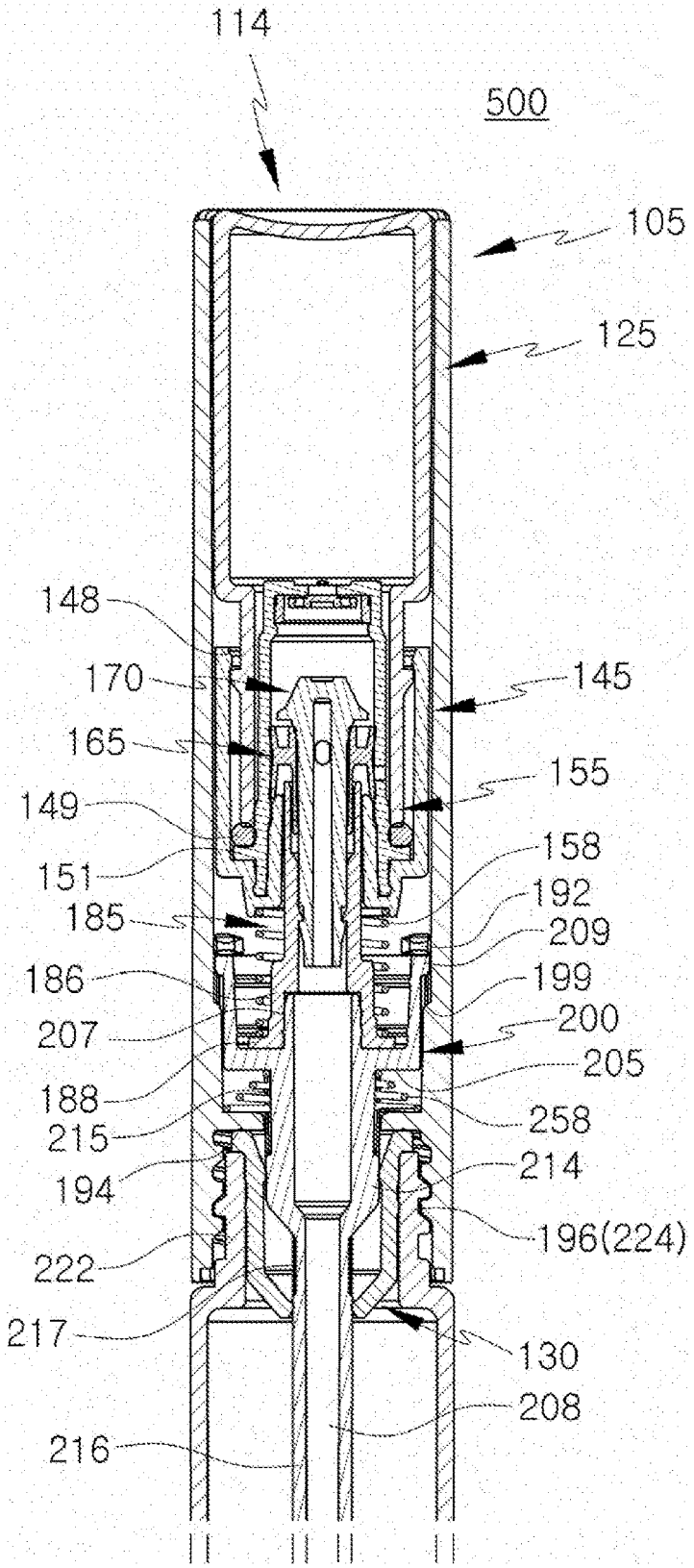
FIG. 10 is a cross-sectional view illustrating a portion of the cosmetic container illustrated in FIG. 6 before an external force is applied.
Figure 11:
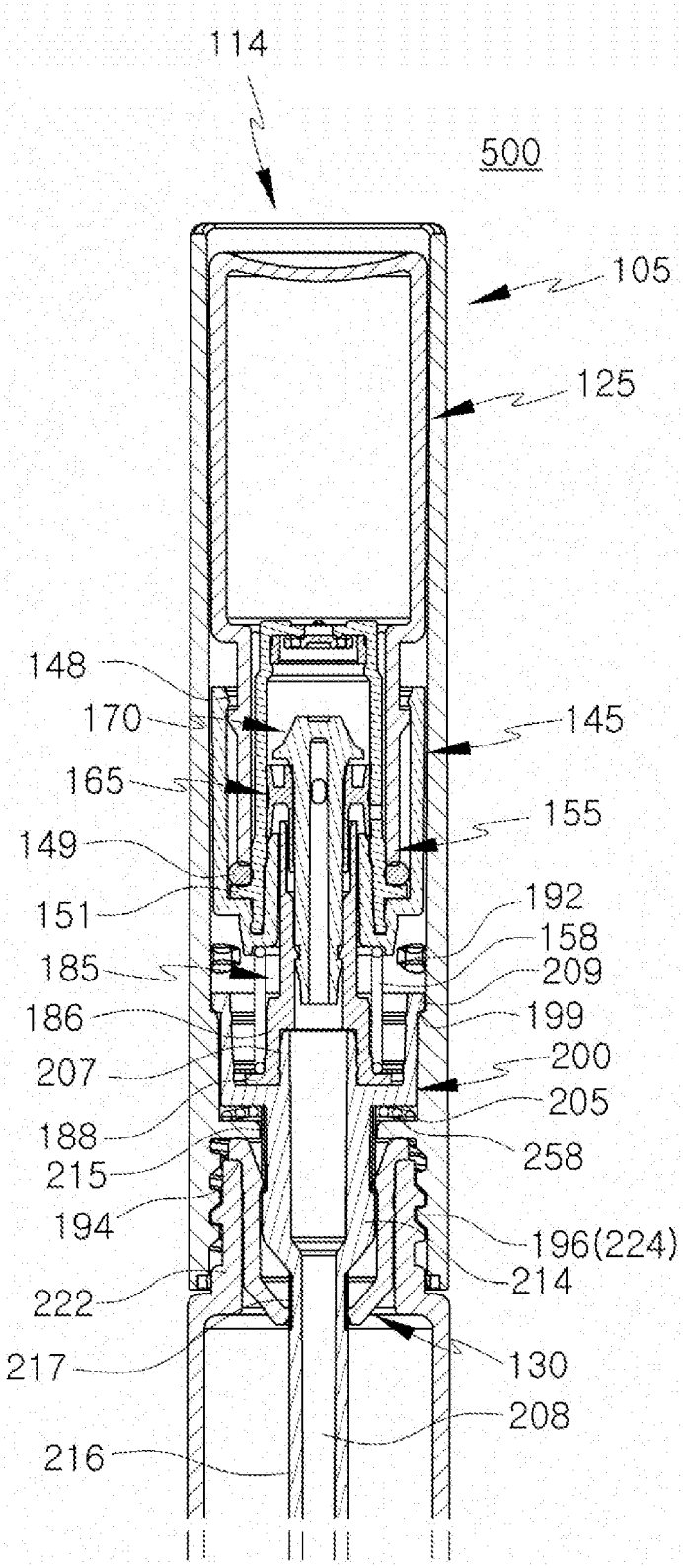
FIG. 11 is a cross-sectional view illustrating a portion of the cosmetic container illustrated in FIG. 6 when an external force is first applied.
Figure 12:
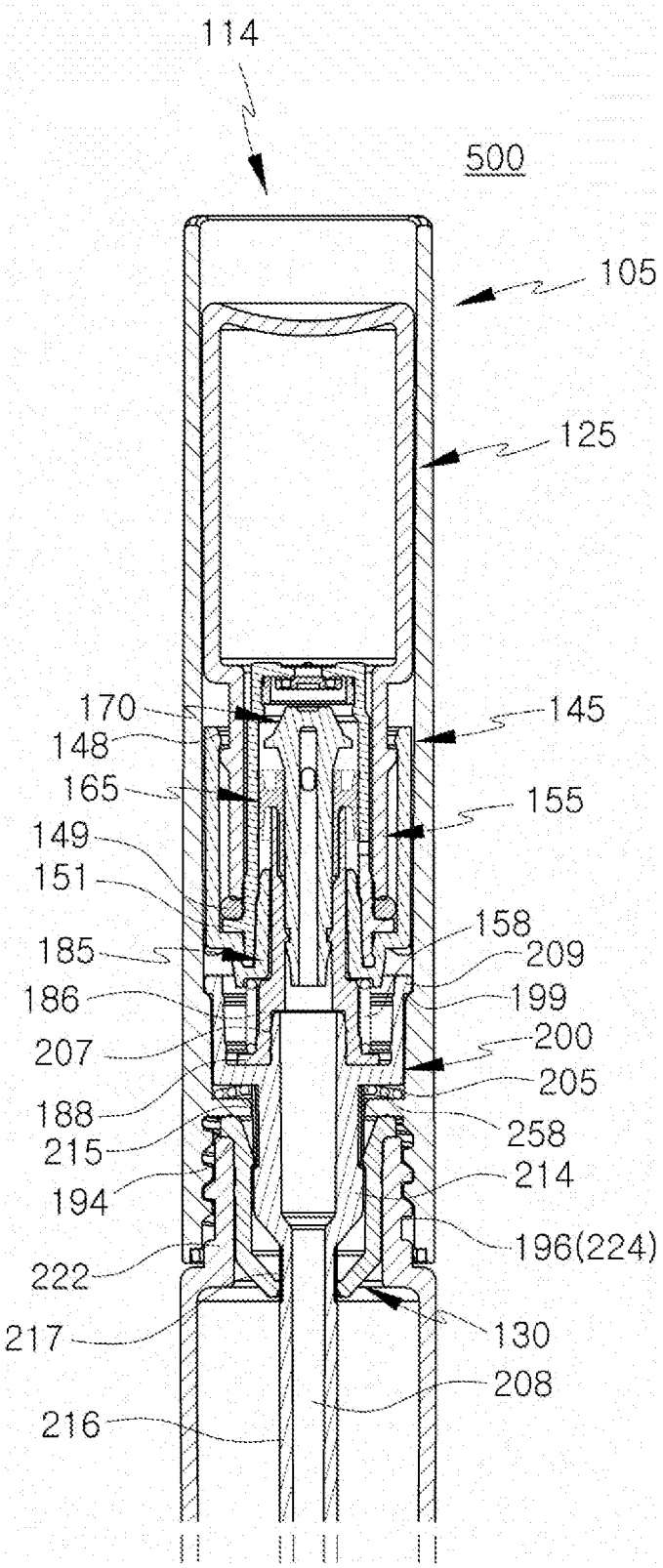
FIG. 12 is a cross-sectional view illustrating a portion of the cosmetic container illustrated in FIG. 6 when an external force is applied further.

A more detailed description is provided below, with reference to FIGS. 10 to 12, on the operation of a cosmetic container 500 according to the second disclosed embodiment of the invention. FIG. 10 is a cross-sectional view illustrating a portion of the cosmetic container 500 illustrated in FIG. 6 before an external force is applied, FIG. 11 illustrates the cosmetic container 500 when an external force is first applied, and FIG. 12 illustrates the cosmetic container 500 when an external force is applied further.

In the state illustrated in FIG. 10, there is as yet no external force applied on the cosmetic container 500, and both the first elastic member 158 and the second elastic member 258 are in undeformed or less deformed states. The first elastic member 158 supports the assembly of the first container 125, housing cover 145, and housing 155 such that the top of the first container 125 is exposed at the open region 114 of the overcap 105, and the second elastic member 258 supports the brush shaft 200 in the first position such that the flange 209 of the brush shaft head 202 contacts the detent protrusion 192.

The packing body 134 of the container packing 130 has an outer diameter corresponding to the inner diameter of the neck part 222 of the second container 220, the flange 132 of the container packing 130 is pressed between the upper end of the second container 220 and the support protrusion 194, and there are sealing protrusions 133, 139 formed on the outer perimeter of the packing body 134 and the upper surface of the flange 132, so that the container packing 130 can seal the second container 220. In addition, when the brush shaft 200 is in the first position, the narrow portion 216 of the brush shaft 200 can tightly contact the sealing protrusion 137 around the through-hole 138, and the broad portion 214 of the brush shaft 200 can tightly contact the sealing protrusion 135 on the inner perimeter of the packing body 134, so that a strong seal can be formed around the brush shaft 200 as well.

In this manner, on the side of the first container 125 and the pump module 140, the first container 125 can be completely sealed by the structures of the neck part 121 of the first container 125, the housing cover 145, and the sealing member 149, while on the side of the second container 220, the second container 220 can be completely sealed by the structures of the overcap 105, the container packing 130, and the brush shaft 200.

If the first content of the first container 125 were to be dispensed into the second container 220 while the second container 220 is in such a completely sealed state, the pressure within the second container 220 may become excessively high, and there is a risk of the second content spurting out when the brush shaft 200 is removed. As such, a cosmetic container 500 according to the second disclosed embodiment of the invention can be structured to maintain the pressure within the second container 220 at a suitable level by allowing a ventilation of the second container 220 before the first content is dispensed into the second container 220 by the pump module 140.

In the state illustrated in FIG. 11, an external force has first been applied on the cosmetic container 500 such that the first container 125 has slightly moved downward. This state may have been achieved, for example, by a user pressing down on the top of the first container 125 exposed through the open region 114 of the overcap 105. This slight downward movement of the first container 125 is due to an elastic deformation of the second elastic member 258, where the brush shaft 200 itself has moved downward. That is, when an external force is first applied, the first elastic member 158 may remain undeformed or only slightly deformed, whereas the second elastic member 258 can be elastically deformed completely, causing the brush shaft 200 to move from the first position to the second position. The brush shaft 200 can move down until the flange 209 of the brush shaft head 202 contacts the detent curb 199.

It is possible to configure the second elastic member 258 to have an elastic modulus that is lower than that of the first elastic member 158, in order that the second elastic member 258 may be deformed before the first elastic member 158 and to a greater extent than the first elastic member 158. However, even if the first elastic member 158 and the second elastic member 258 have similar elastic moduli, it can be expected that the second elastic member 258 would be deformed first because of the high pressure levels within the pump module 140 and the second container 220.

When the brush shaft 200 is moved down to the second position as in FIG. 11, the venting indentations 217 formed in the narrow portion 216 of the brush shaft body 218 may be positioned at the sealing protrusion 137 of the wiper 136, thereby creating gaps between the wiper 136 and the brush shaft body 218. Thus, the sealing protrusion 137 may no longer provide a seal, and the air within the second container 220 can flow through the venting indentations 217 into the space on the inside of the container packing 130.

Likewise, when the brush shaft 200 is moved down to the second position, the venting indentations 215 formed in the broad portion 214 of the brush shaft body 218 may be positioned at the sealing protrusion 135 of the packing body 134, thereby creating gaps between the packing body 134 and the brush shaft body 218. Thus, the sealing protrusion 135 may no longer provide a seal, and the air in the space on the inside of the container packing 130 can flow through the venting indentations 215 to the space above the support protrusion 194.

Thus, the air within the second container 220 can flow through the venting indentations 217 to the space on the inside of the container packing 130, and the air within the space inside the container packing 130 can flow through the venting indentations 215 to the space above the support protrusion 194. Since the brush shaft head 202, pump module 140, and first container 125 are not sealed with respect to the wall 116 of the overcap 105 in the housing space 115 above the support protrusion 194, the air from the second container 220 can be discharged to the exterior, and the pressure within the second container 220 can be lowered to a suitable level.

In the state illustrated in FIG. 12, an external force has been applied further on the cosmetic container 500, causing the first container 125 to move down further. This state may have been achieved, for example, by a user pressing further down on the top of the first container 125 to dispense the first content into the second container 220. Of course, when a user presses down on the top of the first container 125, the user generally would not be conscious that the deforming of the second elastic member 258 and the deforming of the first elastic member 158 occurred separately and would only desire a dispensing of the first content. However, the above-described operation of ventilating the second container 220 would precede the action for dispensing the first content, even if this is not perceived by the user.

When the first container 125 is pressed further while the second elastic member 258 is already in an elastically deformed state, the pump module 140 can be operated, as the first elastic member 158 is elastically deformed. That is, as illustrated in the descriptions above provided with regard to the first disclosed embodiment, the first content that had been drawn into the housing 155 can be dispensed, by the pump module 140, through the flow channels 176, 184 and discharge channel 208 to the interior of the second container 220. Here, since the brush shaft 200 has previously already been moved to the second position, and since the air within the second container 220 can be exhausted to the exterior through the venting indentations 215, 217, the pressure within the second container 220 may not be increased even though the first content is dispensed into the second container 220.

When the user removes the force applied on the first container 125, the first and second elastic members 158, 258 can return to their original positions, and the first content can be supplemented in the housing 155. The user can then separate the overcap 105 from the second container 220 and can use the brush 212 to apply the second content diluted with the first content to a required area. When the overcap 105 is separated, the narrow portion 216 of the brush shaft 200 can pass by the wiper 136, and the wiper can 136 can remove the second content off the surface of the narrow portion 216.

As described above, certain embodiments of the invention allow the user to dilute a second content with a first content, so that the user may conveniently use the second content even when the second content has become hardened or concentrated due to drying.

Also, certain embodiments of the invention can strongly seal the first container holding the first content and the second container holding the second content to thus prevent any leakage of the contents, all while keeping the pressure inside the second container at a suitable level.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

a first container configured to hold a first content;

an overcap in which the first container is arranged, an open region being formed in an upper portion of the overcap to expose a portion of the first container;

a brush shaft comprising a brush shaft head and a brush shaft body, the brush shaft head being arranged within the overcap, the brush shaft body having a discharge channel and a discharge hole-formed, the discharge channel being configured to allow a passage of the first content, the discharge hole connecting the discharge channel with an exterior;

a pump module disposed within the overcap, the pump module being coupled to an opening of the first container and the brush shaft so as to dispense the first content from the first container to the discharge channel, the pump module comprising a first elastic member for elastically supporting the first container such that the first container is movable relative to the brush shaft;

a second container separably coupled to the overcap and configured to hold a second content, the second container being configured to receive a portion of the brush shaft body;

a container packing coupled to a neck part of the second container and made from a flexible material, wherein a through-hole is formed in a lower portion of the container packing to accommodate a portion of the brush shaft body; and a second elastic member for elastically supporting the brush shaft such that the brush shaft is movable relative to the overcap between a first position and a second position, wherein a degree of elastic deformation of the second elastic member at the second position is greater than a degree of elastic deformation of the second elastic member at the first position, wherein the container packing comprises:

a packing body having a cylindrical shape and having an outer diameter corresponding to an inner diameter of the neck part of the second container; and a wiper located below the packing body, wherein the through-hole is formed in the wiper, wherein the brush shaft body comprises:

a broad portion having an outer diameter corresponding to an inner diameter of the packing body; and a narrow portion having an outer diameter corresponding to an inner diameter of the through-hole, wherein a sealing protrusion configured to contact an outer perimeter of the broad portion is formed on an inner perimeter of the packing body, and a venting indentation is formed in the broad portion, the venting indentation being configured to be positioned at the sealing protrusion such that at least a portion of the sealing protrusion does not contact the broad portion when the brush shaft is moved to the second position.

2. The cosmetic container of claim 1, wherein a support protrusion is formed on an inner perimeter of the overcap, an outwardly protruding flange is formed on an upper portion of the packing body, and the flange is pressed between the support protrusion of the overcap and the neck part of the second container when the overcap is coupled to the second container.

3. The cosmetic container of claim 2, wherein the second elastic member is disposed between the support protrusion and the brush shaft head.

4. The cosmetic container of claim 2, wherein a sealing protrusion is formed on an upper surface of the flange.

* * * * *